United States Patent [19]

Rahn

[11] 4,177,128

[45] Dec. 4, 1979

[54] CATHODE ELEMENT FOR USE IN ALUMINUM REDUCTION CELL

[75] Inventor: Henry W. Rahn, Pittsburgh, Pa.

[73] Assignee: PPG Industries, Inc., Pittsburgh, Pa.

[21] Appl. No.: 971,605

[22] Filed: Dec. 20, 1978

[51] Int. Cl.[2] ..... C25C 3/00; C25C 3/06; C25C 3/16

[52] U.S. Cl. ..... 204/243 R; 204/250; 204/280

[58] Field of Search ..... 204/243 R, 244–247, 204/67, 64 R, 250, 280

[56] References Cited

U.S. PATENT DOCUMENTS

| | | | |
|---|---|---|---|
| 3,475,314 | 10/1969 | Johnston | 204/243 R |
| 3,535,214 | 10/1970 | Winand | 204/64 R |
| 3,723,287 | 3/1973 | Elliott | 204/243 R |
| 4,071,420 | 1/1978 | Foster et al. | 204/243 R X |

*Primary Examiner*—John H. Mack
*Assistant Examiner*—D. R. Valentine
*Attorney, Agent, or Firm*—Edward J. Whitfield

[57] ABSTRACT

An improved cathode element for use in a metal, e.g., aluminum reduction cell, said cathode element comprising an elongated hollow body, the lower end of which is affixed to or imbedded in the floor of the cell, the upper end of which terminates proximate the anode said upper end provided with a cap element formed of an electrically conductive material said cap element being in electrically conductive communication with a body of molten metal confined within the hollow body.

5 Claims, 4 Drawing Figures

FIG. 1
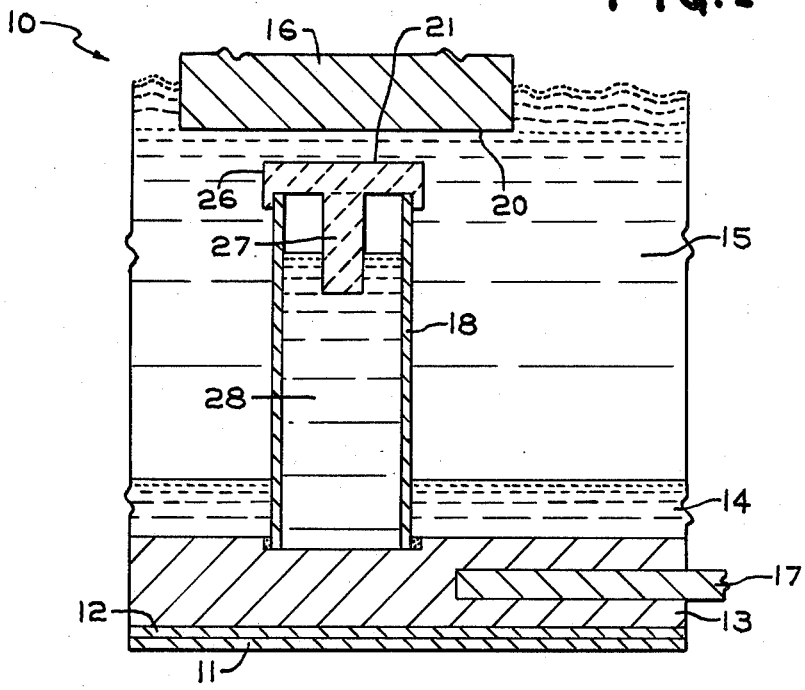
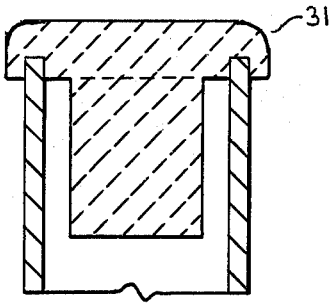
FIG. 2
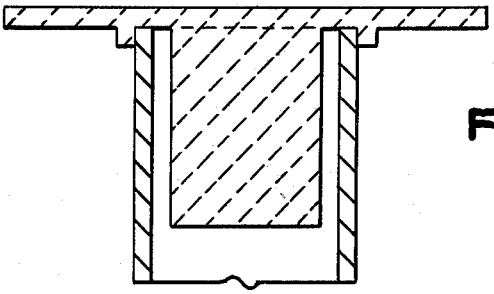
FIG. 3
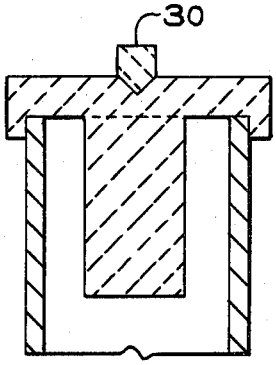
FIG. 4

CATHODE ELEMENT FOR USE IN ALUMINUM REDUCTION CELL

BACKGROUND OF THE INVENTION

Aluminum is typically produced by the Hall-Heroult electrolytic reduction process wherein aluminum oxide dissolved in molten cryolite is electrolyzed at a temperature of from 900° C. to 1000° C. The process is conducted in a pot-type reduction cell which typically comprises an insulated steel shell lined with carbon or other refractory materials to contain the molten constituents. Iron conductor bars connected to a source of direct current are typically imbedded in the carbon lining comprising the floor of the cell and a carbon anode is suspended in the cell. Molten aluminum is electrolyzed out of the aluminum oxide-cryolite melt and collects on the carbon floor of the cell and is continuously or periodically withdrawn. A layer or pad of molten aluminum is maintained on the carbon floor of the cell which molten aluminum and carbon floor function as a cathodic surface.

To minimize voltage drop and optimize cell efficiency, the gap between the anode and the surface of the aluminum pad should be maintained as small as possible, preferably not more than about 3 centimeters. But this desirably close anode-cathode spacing is difficult to maintain due to magnetic induction currents which cause large perturbations in the molten aluminum pad which increase the risk of short circuiting the system by contact between the molten aluminum and the anode. For example, in a typical cell, the spacing between the anode and the surface of the molten aluminum pad cannot as a practical matter, be maintained at less than about 4 centimeters.

One means of overcoming this problem is disclosed in U.S. Pat. No. 4,071,420 wherein an array of cathode elements in the form of hollow bodies or tubular elements filled with molten aluminum protrude up through the aluminum pad and extend into the cryolite layer and terminate proximate the anode.

This arrangement has the effect of removing the region of electrolytic activity from the surface of the aluminum pad to the surfaces of the elements and their contained aluminum pools confronting the anode. Although this construction reduces the perturbative effect of magnetic induction currents and enables more precise control of the anode-cathode gap, i.e. 2 centimeters or less particles of undissolved bath materials or sludge tend to settle out in the bottom of the hollow bodies. Sludge accumulation in the interior of the hollow bodies is particularly disadvantageous when the hollow bodies are formed of an electrically non-conductive material since the sludge layer could act as an insulator and could disrupt the flow of electrical current from the carbon floor to the molten aluminum overlying the sludge layer.

Even in the case when the hollow bodies are formed of electrically conductive material, over an extended operating period sludge could build-up so as to substantially or completely fill the hollow body thus significantly impairing its ability to efficiently function as a cathodically active surface.

SUMMARY OF THE INVENTION

An improved cathode element for use in an aluminum reduction cell, said element comprising an elongated hollow body extending upwardly through the molten aluminum pad, the lower end of said member affixed to the floor of the cell, the upper end of said member extending into the molten cryolite, said upper end being provided with a cap formed of an electrically conductive material, said cap being in electrically conductive communication with a body of molten aluminum contained within said elongated hollow body.

DESCRIPTION OF THE DRAWINGS

FIG. 1 is a fragmentary, diagrammatic, vertical sectional view of a typical aluminum reduction cell illustrating one embodiment of the cathode element of the invention.

FIGS. 2, 3, and 4 depict alternative embodiments of the cathode element of the invention.

DESCRIPTION OF THE INVENTION

The cell depicted in the drawings is a conventional aluminum reduction cell and consequently, with the exception of the cathode element, will be described in only general terms. With reference to FIG. 1, 10 indicates an aluminum reduction cell including an outer shell 11, insulation 12, and carbon lining 13 defining a space for containing a pad of molten aluminum 14 and molten bath constituents 15. Also included in cell 10 is anode 16 and cathode voltage supply bus 17 each connected to a current source, not shown.

In one embodiment of the invention, the cathode element comprises an elongated hollow body 18, the lower end of which is affixed to or embedded in the carbon lining 13. Hollow body 18 extends upwardly through the aluminum pad 14 into the cryolite layer 15 and is provided with a cap element 26 having a cathodically active surface 21 confronting the under surface 20 of anode 16 and provided on its underside with at least one downwardly depending member 27, which extends into the interior of hollow body 18 and is in contact with a body of molten aluminum 28 confined within hollow body 18, thus providing an electrically conductive path from the cathode voltage supply bus 17 embedded in carbon lining 13 to the cathodically active surface 21 of cap 26.

The dimensions of cap 26 and its mode of engagement with hollow body 18 may vary considerably, so long as the cap fits sufficiently snug so as not to allow entrance of bath material into the interior of hollow body 18. For example as shown in FIG. 1, the periphery of cap 26 is formed as a downwardly depending annular flange which engages the outer periphery of the upper end of hollow body 18 when the cap is in place, to assure accurate placement of the cap and to prevent lateral movement of the cap with respect to the hollow body.

The cap element may be of unitary molded construction or the depending member may be secured to the underside of the cap by, for example, threaded engagement. It is of course to be understood that a plurality of depending members may be provided rather than the single depending member illustrated. Although the relative dimensions of the cathodically active surface and the depending member are not particularly critical in order to assure satisfactory electrical conductance the cross-sectional area of the depending member should be at least about 5 percent of the cross sectional area of the cathodically active surface. Typically, the ratio between the cross-sectional area of the cathodically active surface and the cross-sectional area of the depending member need not be less than about 10 to 1. Although cross-sectional area ratios less than 10 to 1 may be used, electrical conductivity is not particularly enhanced thereby.

The total surface of the downwardly depending member in contact with the molten aluminum contained within the hollow body should be at least about 5 percent and preferably at least about 10 percent of the surface area of the cathodically active surface.

An alternate mode of engagement is illustrated in FIG. 2 wherein the underside of the cap is provided with an annular groove which engages the upper end of the hollow body.

FIG. 3 illustrates yet another embodiment wherein the cathodically active surface area of the cap is appreciably larger than the cross-sectional area of the hollow body.

As further depicted in FIG. 2, the upper periphery of the cap may be rounded or beveled as indicated at 31 to minimize chipping or cracking should there be contact between the anode and the cap.

As before mentioned, the gap between the anodic and cathodic surfaces should be maintained as close as possible both to minimize voltage drop and optimize cell efficiency. Desirably, the spacing between the anodic and cathodic surfaces is typically not more than about 3 centimeters and preferable, less than 2 centimeters. However, under operating conditions, this desirably small spacing is often difficult to maintain and there is an ever present risk of short circuiting the system by inadvertent contact between the anode and the molten aluminum being formed at the cathode surface. The embodiment of the invention illustrated in FIG. 4 is designed to both provide means of maintaining desirably close spacing between the anodic and cathodic surfaces while at the same time preventing inadvertent contact therebetween.

In FIG. 4, the cathodically active surface of the cap is provided with at least one upwardly projecting stud 30. The vertical dimension of the stud is chosen such that it permits desirably close spacing between the undersurface of the anode while preventing contact between the under-surface of the anode and the layer of molten aluminum formed on the cathodically active surface. The stud is, of course, formed of an electrically non-conductive material, e.g., silicon carbide.

Preferably the cap is provided with a plurality of studs spaced about the periphery of the cap and in substantially vertical alignment with relation to the side walls of the hollow body which arrangement better serves to relieve stress on the assembly induced by the weight of the anode.

With regard to the geometry of the cathode elements of the invention, there is no restriction regarding their cross-sectional shape, i.e., they may be square, circular, rectangular, or of any plane regular or irregular geometric shape. There is also no restriction regarding the length to diameter ratio of the cathode elements, i.e. they may range from wide and square to narrow and thin. Further, there is no restriction on the shape of the top surface of the cap i.e., it may be flat or grooved or slightly sloped to provide for enhanced drainage of molten aluminum. Although a single cathode element having a relatively large cross-sectional area may be used, an array of elements, each having a relatively small cross-sectional area, is preferred as described for example in U.S. Pat. No. 4,071,420.

Likewise, the quantity of molten aluminum contained within the hollow body is not particularly critical so long as there is sufficient aluminum in contact with the downwardly depending member to provide satisfactory transmission of electrical current to the cathodically active surface of the cap. It will, of course, be realized that the aluminum contained within the hollow body will only be in the molten state when the cell is at operating temperature. Thus, prior to cell startup, a sufficient quantity of solid aluminum is placed in the hollow body to provide a sufficient body of molten aluminum when the cell attains operating temperature.

The elongated hollow body may be formed of any material that is resistant to the cell environment over an extended operating period. The material should be capable of satisfactorily withstanding attack from the molten bath constituents under operating temperature and should have a satisfactory resistance to thermal stress engendered by temperature fluctuations in the molten bath. Suitable materials for use in constructing the hollow bodies are in general the so-called refractory hard metals, particularly the carbides, borides, and silicides of titanium or zirconium. Silicon carbide may also be used. Typically, the hollow bodies are formed by densifying a finely divided powder of the selected material. Densification may be effected by conventional techniques, e.g., hot pressing or cold pressing and sintering.

In like manner, the cap element is formed of a material that is resistant to the cell environment with the added proviso that the cap element be fabricated of an electrically conductive material namely one of the aforesaid refractory hard metals. Of tne refractory hard metals, titanium diboride is particularly preferred due to its good electrical conductance, thermal stability and its ability to be wetted by molten aluminum, and its insolubility in molten cryolite and alumina.

Although the cathode element of the invention has been described with reference to preferred embodiments thereof, and with particular reference to its employment in an aluminum reduction cell, it is apparent that many variations may be made therein by those skilled in the art without departing from the spirit and scope of the invention. For example, the cathode element of the invention may be employed in any molten metal production process wherein a metal compound or a metal compound dissolved in a molten solvent is electrolyzed between anodic and cathodic surfaces.

I claim:

1. In an electrolytic cell wherein metal is produced in the molten state by electrolyzing a compound of the metal between anodic and cathodic surfaces said molten metal collecting in a pad on the floor of the cell the improvement wherein said cathodic surface is provided by a cathode element comprising at least one elongated hollow body having confined therein a quantity of molten metal, said hollow body extending upwardly through the molten metal pad and terminating proximate the anodic surface, the end of said hollow body terminating proximate the anodic surface being provided with a cap element formed of an electrically conductive material, the upper surface of the cap element confronting the surface of the anode in spaced relationship thereto, the cap element being in electrically conductive communication with the molten metal confined within the hollow body.

2. The electrolytic cell of claim 1 wherein the cap element is in electrically conductive communication with the molten metal confined within the hollow body by the provision on the undersurface of the cap element of at least one depending member formed of an electrically conductive material said depending member extending into the molten metal contained within the hollow body.

3. The electrolytic cell of claim 1 wherein the hollow body is formed of silicon carbide and the cap element is formed of titanium diboride.

4. The electrolytic cell of claim 1 wherein the surface of the cap element confronting the surface of the anode is provided with at least one upwardly projecting stud formed of an electrically non-conductive material, the vertical dimension of the stud being chosen such that it permits desirably close spacing between the cathodic and anodic surfaces while preventing contact between the anodic surface and the layer of molten metal formed on the cathodically active surface.

5. The electrolytic cell of claim 4 wherein the stud is formed of silicon carbide.

* * * * *